US007444101B2

(12) United States Patent
Calamita

(10) Patent No.: US 7,444,101 B2
(45) Date of Patent: Oct. 28, 2008

(54) SYSTEMS AND METHODS FOR IMPROVING BELT MOTION AND COLOR REGISTRATION IN AN IMAGE FORMING DEVICE

(75) Inventor: James Patrick Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 138 days.

(21) Appl. No.: 11/549,802

(22) Filed: Oct. 16, 2006

(65) Prior Publication Data

US 2008/0089703 A1 Apr. 17, 2008

(51) Int. Cl.
*G03G 15/00* (2006.01)

(52) U.S. Cl. ..... 399/167

(58) Field of Classification Search ..... 399/36, 399/162, 167

See application file for complete search history.

(56) References Cited

U.S. PATENT DOCUMENTS 5,325,155 A * 6/1994 Perry ..... 399/167
6,941,096 B2 * 9/2005 Matsuda et al. ..... 399/167
7,263,314 B2 * 8/2007 Ueda et al. ..... 399/167

* cited by examiner

*Primary Examiner*—Sandra L Brase
(74) *Attorney, Agent, or Firm*—Oliff & Berridge, PLC

(57) ABSTRACT

A method and system of correcting a medium velocity error in a photoreceptor belt of an image forming device with a controller, including measuring a velocity error of the photoreceptor belt when the medium is used in the image forming device, the velocity error comprising a velocity error due to the image forming device dynamics and a velocity error due to torque disturbance on the photoreceptor belt, filtering high frequency velocity error from the measured velocity error, removing the velocity error due to the image forming device dynamics from the measured velocity error to produce a remaining velocity error, converting the remaining velocity error to torque disturbance, determining a correction factor on the basis of the torque disturbance, and correcting the medium velocity factor on the basis of the determined correction factor.

12 Claims, 6 Drawing Sheets

SYSTEMS AND METHODS FOR IMPROVING BELT MOTION AND COLOR REGISTRATION IN AN IMAGE FORMING DEVICE

BACKGROUND

This disclosure is directed to systems and methods for measuring belt velocity error and reducing torque disturbance in the photoreceptor of image forming devices.

A variety of systems and methods are conventionally used for velocity control in image forming devices. Such systems and methods can include classically designed velocity feedback systems supplemented by a periodic feed-forward control scheme, and feed-forward control algorithms that compensate for an acoustic transfer assist (ATA) vacuum, or drag on the belt, that are disturbed as the belt seam passes over the ATA. This generally involves measuring the transient in belt velocity that is caused by the temporary loss of drag, and commanding the photoreceptor drive motor in a fashion contrary to and simultaneous to the loss in drag. Such a feed-forward control scheme is generally highly effective because the position of the transient is constant, can be tracked as a function of belt position, and varies slowly over time. Moreover, the shape and nature of this disturbance is generally in the form of $\sin^3$, so only the height, width and start point of the correction needs to be known.

FIGS. 1 and 2 illustrate a side elevation view and a front elevation view, respectively, of a schematic of a transfer subsystem 100, which includes a photoreceptor belt 110. A photoreceptor belt motor drive unit 122 engages the photoreceptor belt 110 and moves the photoreceptor belt 110 across a series of support rollers 124, 130, 132, 134, 142, 144, 146, and/or a plurality of non-rotating support bars 152, 154, 156, 158.

Typically, photoreceptor belts are fabricated from long sheets of photoreceptor material that are cut to size. The ends of the cut photoreceptor material are welded, or otherwise mated, together in order to form a continuous belt. This fabrication process produces a photoreceptor belt seam 115 at the point where the ends of the photoreceptor belt 110 are welded, or otherwise mated, to be joined together.

Some transfer subsystems, such as the one shown in FIGS. 1 and 2, include an ATA module 120, which draws the photoreceptor belt 110 into a plenum using a vacuum. The ATA module 120 vibrates the photoreceptor belt 110 in the plenum to aid in transferring toner from the photoreceptor belt 110 to an image receiving medium.

In areas of the photoreceptor belt 110 where there is no seam, a tight vacuum is maintained in the ATA module 120. However, when the photoreceptor belt seam 115 of the photoreceptor belt 110 crosses the ATA module 120, the vacuum seal is momentarily broken. Drag of the photoreceptor belt 110 on the photoreceptor belt motor drive unit 122 is momentarily reduced causing the photoreceptor belt motor drive unit 122 to speed up. Speed of the photoreceptor belt motor drive unit 122 must generally be tightly controlled. Photoreceptor belt velocity sensors (not shown) sense the increase in velocity of the photoreceptor belt motor drive unit 122. A motor control device reacts to readjust the speed of the photoreceptor belt motor drive unit 122 and the photoreceptor belt 110.

New U.S. patent application Ser. No. 11/125,103, entitled "Systems and Methods for Determining Feed Forward Correction Profile For Mechanical Disturbances In Image Forming Devices" by James Calamita, filed on May 10, 2005, which is commonly assigned, teaches a control system to automate and/or adapt feed-forward correction (FFC) profile to match precisely the timing and nature of a torque disturbance in a transfer subsystem, which may reduce or substantially nullify torque disturbances, such as, for example, torque disturbances caused by a photoreceptor belt seam passing over an ATA in a photoreceptor belt-based transfer subsystem in an electrophotographic and/or xerographic image forming device. Ser. No. 11/125,103 also provides a learning algorithm using a correlated model of system dynamics to compensate for torque disturbances in mechanical systems, such as, for example, transfer subsystems, in image forming devices.

New U.S. Patent Application entitled "Systems and Methods for Reducing Torque Disturbance in Devices Having an Endless Belt" by Kevin M. Carolan, U.S. Pat. No. 7,157,873 filed on May 5, 2005, which is commonly assigned, teaches a control system to compensate for motion disturbances which may cause defects in multi-color output images produced by image forming devices. The disclosed system may include a controller that determines when a torque disturbance is expected to occur and controls the photoreceptor belt motor drive unit with a compensation amount that may be retrieved from a data structure. This compensation amount from the data structure may be adjusted via a gain factor and may be combined with the output of a closed loop compensator at a summation point, to attempt to minimize the misregistration effect produced by the torque disturbance in the output images produced by the image forming device. U.S. Pat. No. 7,157,873 employs a timing methodology to anticipate the onset of a disturbance and via the controller attempts to insert an opposing profile that causes the photoreceptor belt motor drive unit to generate an opposing torque to substantially nullify the disturbance. Amplitude of a correction profile, corresponding to the amplitude of the disturbance, is manually adjusted to attempt to minimize the effects of the disturbance on the produced output images, for example, the color-to-color registration error. The controller monitors the onset of the disturbance or predicts the onset of the disturbance based on sensed photoreceptor belt position and encoder timing. Correction factors for the current operating state of the transfer subsystem in the image forming device are obtained substantially through a trial and error method.

SUMMARY

Another source of disturbance to belt velocity is the image forming medium such as, for example, paper, entering and leaving the transfer area. The disturbance in this case is highly dependent upon the medium size and weight as factors external to the photoreceptor, such as pre-transfer medium path speed and pre-fuser transfer medium speed and transfer baffle entry angle. Because there are a number of different variables that contribute to the transients from the medium, it may be desirable to provide a control algorithm capable of tailoring the correction to the specific machine.

Various exemplary embodiments of the systems and methods provide a method of correcting a medium velocity error in a photoreceptor belt of an image forming device with a controller and associated system. The method can include measuring a velocity error of the photoreceptor belt when the medium is used in the image forming device, the velocity error having a velocity error due to the image forming device dynamics and a velocity error due to torque disturbance on the photoreceptor belt. The method can further include filtering high frequency velocity error from the measured velocity error, removing the velocity error due to the image forming device dynamics from the measured velocity error to produce a remaining velocity error, converting the remaining velocity error to torque disturbance, determining a correction factor on the basis of the torque disturbance, and correcting the medium velocity factor on the basis of the determined correction factor.

A system for correcting a medium velocity error in a photoreceptor belt of an image forming device with a controller is also provided. The system can include a measuring unit that measures a velocity error of the photoreceptor belt when the medium is used in the image forming device, the velocity error having a velocity error due to the image forming device dynamics and a velocity error due to torque disturbance on the photoreceptor belt under control of the controller, a filtering unit that filters high frequency velocity error from the measured velocity error, the controller controlling the removal of the velocity error due to the image forming device dynamics from the measured velocity error to produce a remaining velocity error, the controller controlling the conversion of the remaining velocity error to torque disturbance, the controller controlling the determination of a correction factor on the basis of the torque disturbance, and a velocity correction unit that corrects the medium velocity factor on the basis of the determined correction factor.

BRIEF DESCRIPTION OF THE DRAWINGS

Various exemplary embodiments of the systems and methods will be described in detail, with reference to the following figures, wherein.

DETAILED DESCRIPTION OF EMBODIMENTS

These and other features and advantages are described in, or are apparent from, the following detailed description of various exemplary embodiments of the systems and methods.

Figure 1:
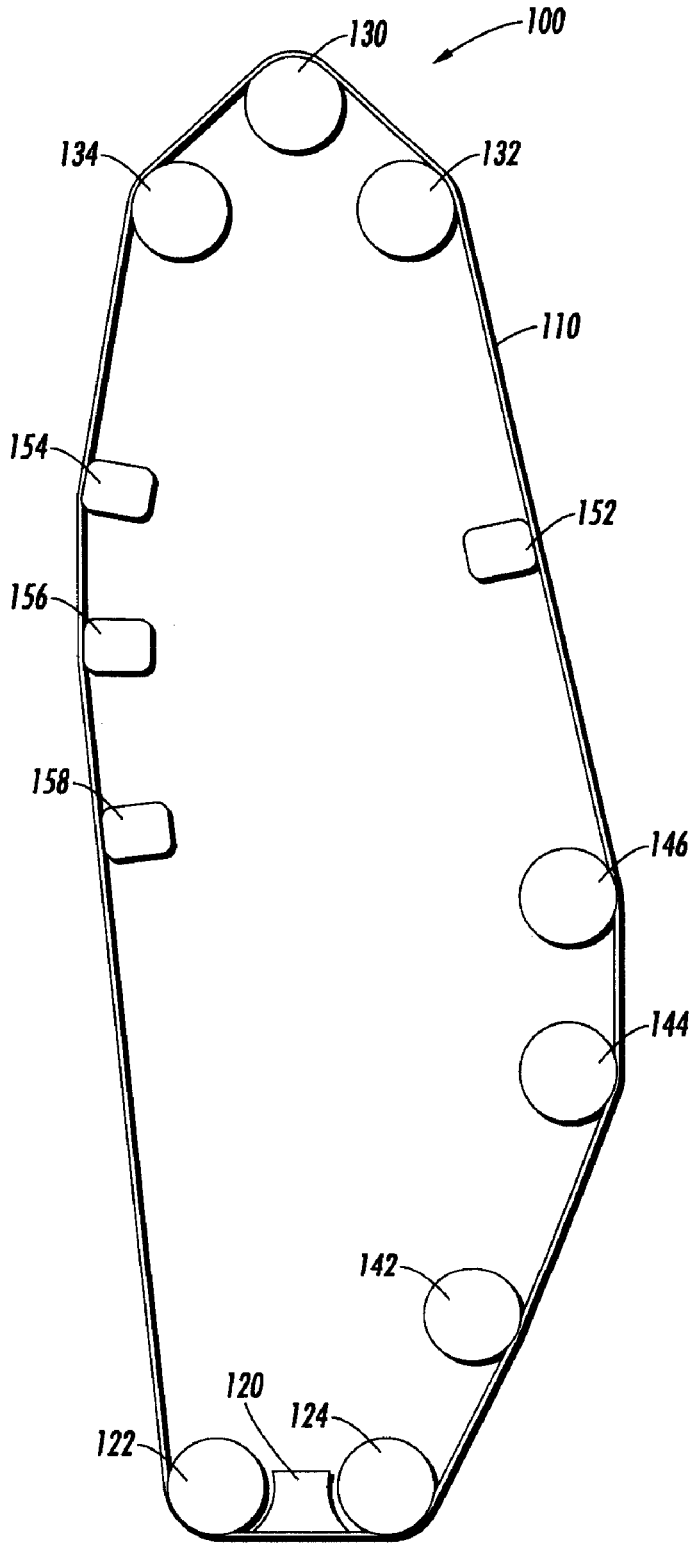
FIG. 1 illustrates a schematic side elevation view of a transfer subsystem for an image forming device including a seamed photoreceptor belt.
Figure 2:
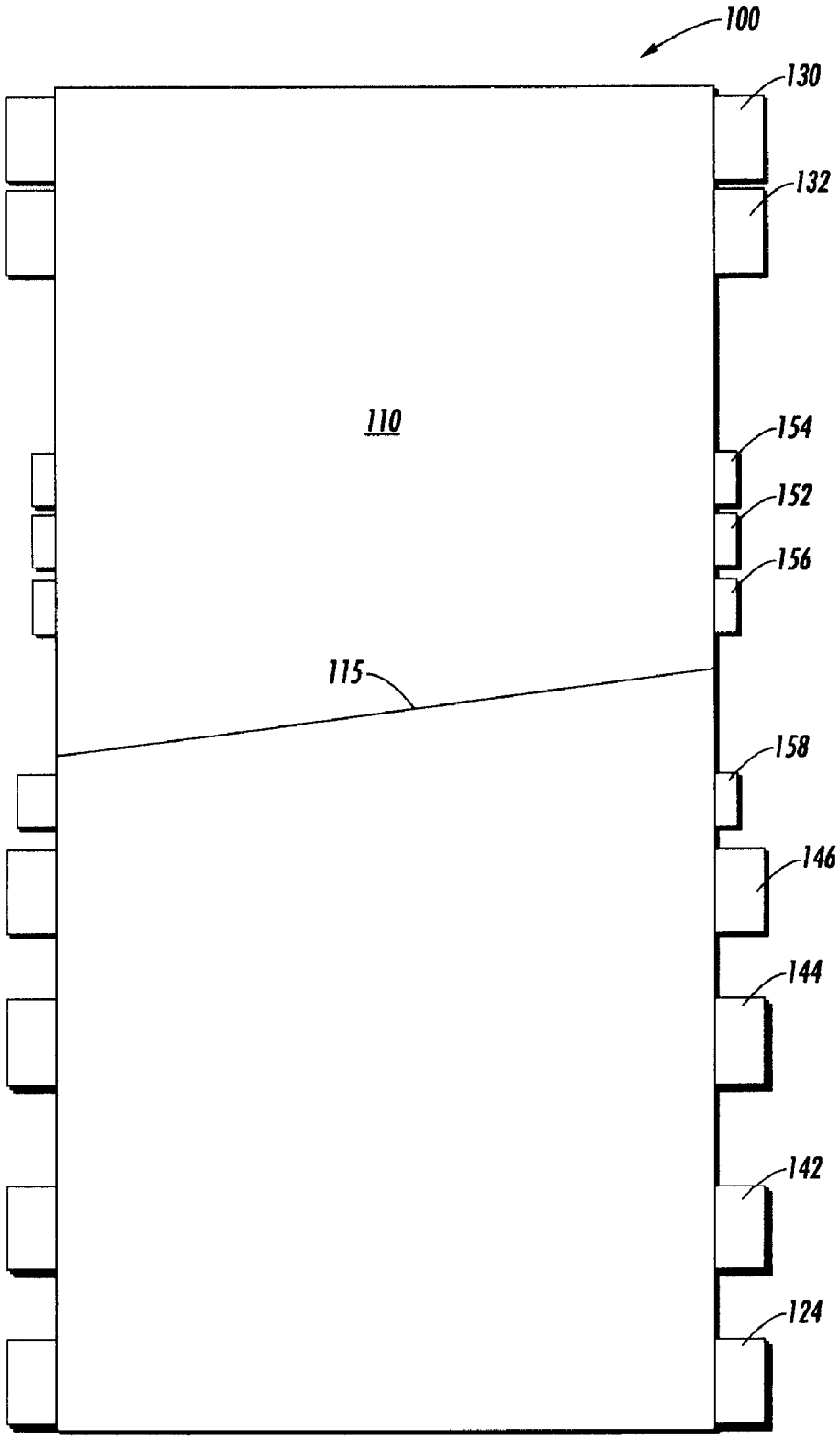
FIG. 2 illustrates a schematic front elevation view of a transfer subsystem for an image forming device including a seamed photoreceptor belt.
Figure 3:
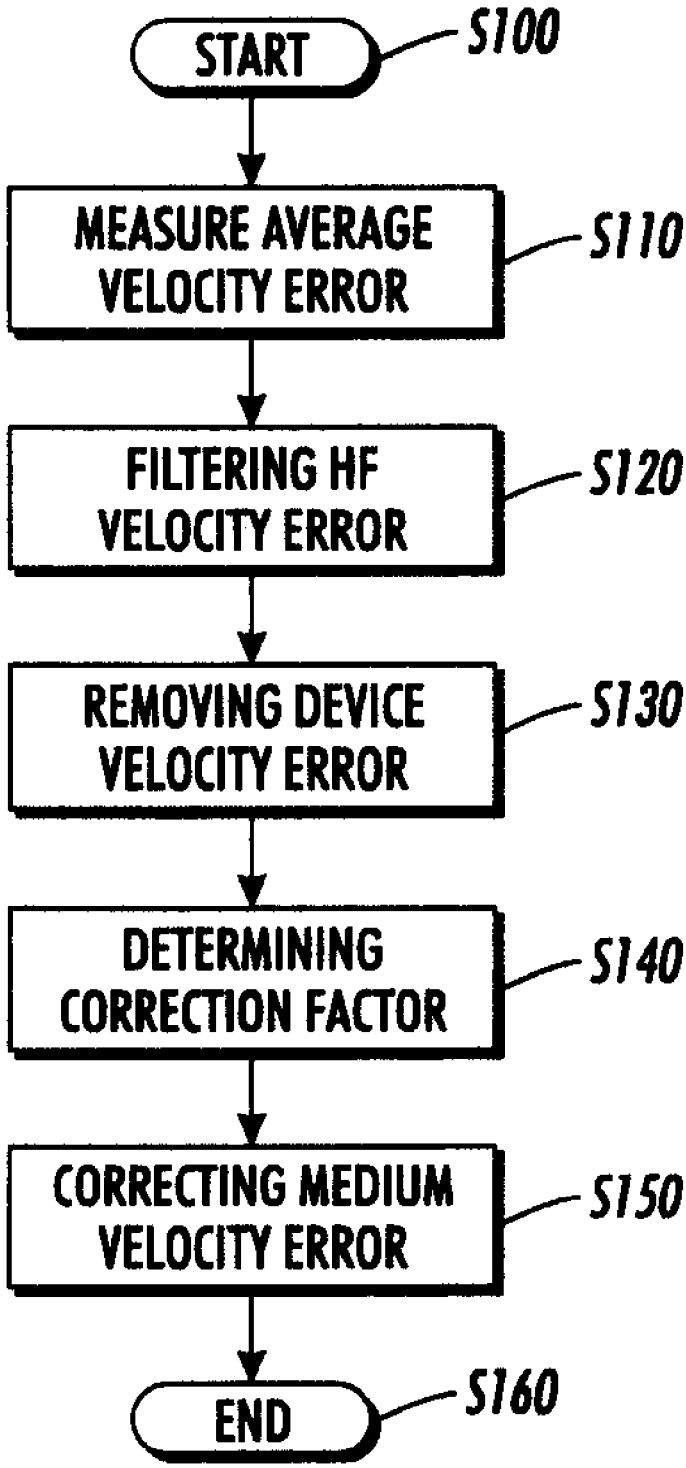
FIG. 3 is a flow chart illustrating an exemplary method for implementing a torque disturbance reduction within the transfer subsystem of an image forming device.

FIG. 3 is a flow chart illustrating an exemplary method for implementing a torque disturbance reduction within the transfer subsystem of an image forming device. In FIG. 3, the method starts in step S100 and continues to step S110, where the average velocity error of the imaging device is measured. According to various exemplary embodiments, a training run can be performed by using the image forming device to form an image on a medium under conditions mimicking conditions existing during an actual image forming operation such as a print job. Alternatively, if the image forming operation is a long job, the training run may be performed on a portion of the job. During the training run, the velocity error may be measured as a function of belt position, at each sample period of the base photoreceptor controller. For example, measurements of velocity error may be performed every 1.6 ms for a 6 seconds belt revolution, which results in taking about 3750 measurements per revolution of the photoreceptor belt. Also, for example, a seam hole on the photoreceptor belt may be used to trigger the data collection and to designate the start of each photoreceptor belt revolution. According to various exemplary embodiments, several such measurements are taken during a plurality of revolutions of the photoreceptor belt during the training run. Thus, the data measured represents 3750 times the number N of revolutions of the photoreceptor belt during the training run. Next, control continues to step S120.

During step S120, the velocity error is filtered by passing the velocity error data through a digital low pass filter (for example a $4^{th}$ order butterworth filter implemented through a difference equation, or the like), thereby removing the high frequencies from the velocity error. According to various exemplary embodiments, the frequencies removed are those above about 10 Hz. If the control bandwidth is much above 10 Hz, the cutoff frequency may be increased accordingly. Once the high frequencies are removed, the total velocity error of the image forming device can be obtained by averaging the velocity error values at each belt position for N successive belt revolutions (alignment of the errors for each belt revolution can be accomplished by using the belt seam hole as a indicator of the start of each revolution). This results in a profile of average velocity error as a function of position on the photoreceptor belt. According to various exemplary embodiments, the average velocity error is measured in mm/s, but also may be measured in encoder counts per second. Next, control continues to step S130.

During step S130, the calculated average velocity error, which is a convolution of errors due to the dynamics of the photoreceptor, the dynamics of the photoreceptor controller, and the torque disturbance of the photoreceptor belt itself, can be further filtered to remove the dynamics of the photoreceptor and the dynamics of the photoreceptor controller. This is performed because the dynamics of the photoreceptor and of the controller are intrinsic to the image forming device and do not depend on external parameters. Accordingly, the average velocity error is passed through a filter that removes the dynamics of the photoreceptor and of the controller, and leaves a remaining velocity error that corresponds to the torque disturbance specific to the interaction between the image forming device and the image receiving medium. In the practice of modeling of classical control systems, it is common to predict the response of a dynamic system to a given disturbance by executing a series of difference equations (for this application, typically $16^{th}$ to $20^{th}$ order) that contain information regarding said dynamic system. Here, operation can be in reverse, by applying the inverse of the dynamic system equations to the output (which is known) in order to obtain the waveform of the disturbing input. According to various exemplary embodiments, the torque disturbance is measured in N-m. Next, control can continue to step S140.

During step S140, and because it is known that the torque disturbance waveform is proportional to the correction waveform required to counteract the torque disturbance, a correction scale factor is determined on the basis of the measured torque disturbance. This scale factor, once determined experimentally, will be valid for all torque disturbances determined by the described method and for all machines of similar construction. Determination of this scale factor can be performed by manually adjusting the amplitude of the correction waveform as it is applied to the machine until a velocity variation is minimized. The scale factor to be applied to the measured torque disturbance waveform is then just the ratio of the optimally corrected waveform to the measured torque disturbance waveform. Next control continues to step S150, where the correction factor is applied to correct the torque disturbance specific to the image forming medium to remedy the velocity error that is due to the specific image receiving medium such as, for example, paper, used in the image forming device. Next, control continues to step S160, where the method ends.

Figure 4:
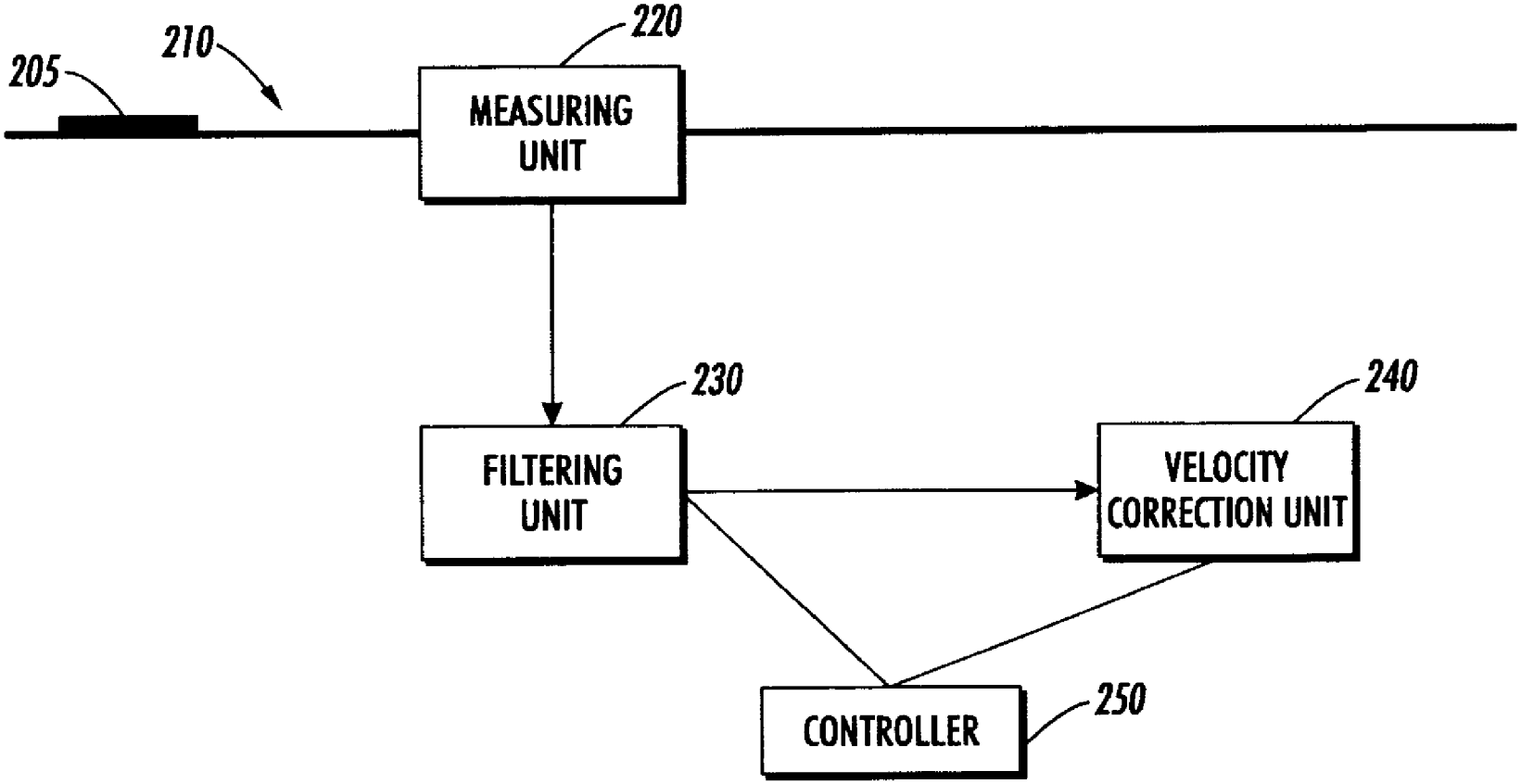
FIG. 4 is an illustration of an exemplary system for implementing a torque disturbance reduction within the transfer subsystem of an image forming device.

FIG. 4 is an illustration of an exemplary system for implementing a torque disturbance reduction within the transfer subsystem of an image forming device. As shown in FIG. 4, the system can include an image receiving medium 205 on a photoreceptor belt 210. A measuring unit 220 is connected to the photoreceptor belt 210, to a filtering unit 230, and a velocity correction unit 240, under control of a controller 250.

In operation, the photoreceptor belt 210 on which the image receiving medium 205 such as, for example, paper, is disposed for an image forming operation. According to various exemplary embodiments, the measuring unit 220 is used to take measurements of data points of velocity error due to the interaction between the photoreceptor belt 210 and the image receiving medium 205 during a training run under control of the controller 250. Even a momentary perturbation in photoreceptor belt velocity during imaging affects imaging results by, for example, producing defects in output hard-copy images transferred to an image receiving medium. Color photoreceptor belt-based systems include a plurality of imaging stations, each for a different one of a plurality of primary colors. Precise control of the velocity and the position of the photoreceptor belt 210 are necessary in order to attempt to ensure that each of the plurality of separate single color images is precisely overlaid on the image receiving medium in order to produce the output color image. When individual single color images do not correctly align, based mechanical transients and/or disturbances in the transfer subsystems such as, for example, velocity and/or position mismatches, or transient errors in control of the photoreceptor belt 210, image quality will decrease because the colors do not precisely line up. Such defects in output hard-copy images in electrophotographic and/or xerographic image forming devices are referred to alternatively as misregistration of colors or color-to-color registration errors. Such misregistration of colors may initially fall below any detectable threshold, but increases, i.e., becomes more pronounced and/or noticeable, as image-on-image systems and/or system components age or wear under use.

The filtering unit 230 may then filter the average velocity error to remove error due to the dynamics of photoreceptor, under control of the controller 250. The filtering unit 230 may also convert, under control of the controller 250, the filtered average velocity error to torque disturbance. According to various exemplary embodiments, the conversion is performed by the controller 250. Once the velocity error is converted to torque disturbance, the velocity correction unit 240 determines the correction factor and applies the correction factor to the photoreceptor belt 210 to counteract the velocity error that is due to the interaction between the photoreceptor belt 210 and the image forming medium 205.

Figure 5:
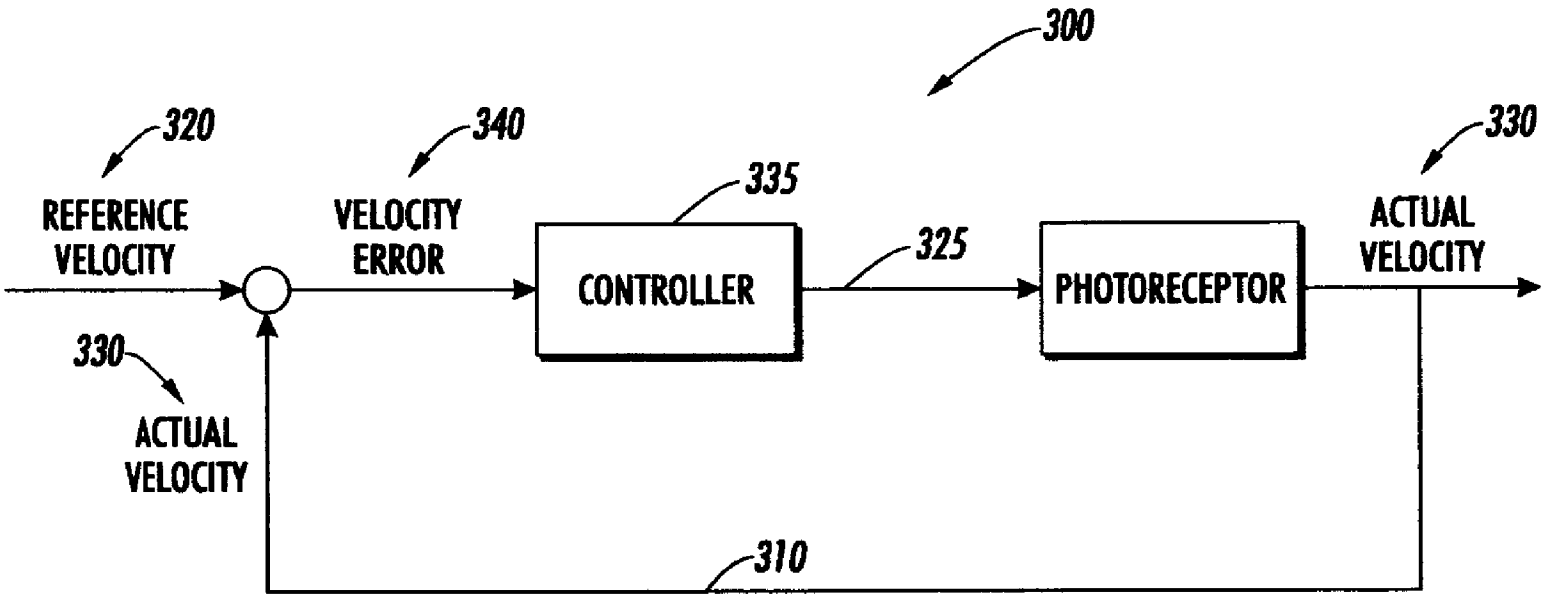
FIG. 5 is a process flow diagram illustrating a feedback loop calculating the velocity error.

FIG. 5 is a process flow diagram illustrating a system 300 for calculating the velocity error of the photoreceptor belt via a feedback loop 310. As shown in FIG. 5, the reference velocity 320, which is the initial velocity of the photoreceptor belt, is set for the photoreceptor belt 325. The photoreceptor belt 325 travels under control of the controller to move the imaging medium through the image forming device. At various points on the photoreceptor belt, the actual velocity 330 of the photoreceptor belt 325 is measured under control of the controller 335. A difference between the actual velocity and the reference velocity is then measured, which is the velocity error 340, and the velocity error 340 is used as a basis to adjust the actual velocity 330 of the photoreceptor belt 325. For example, measurements of the actual velocity 330 of the photoreceptor belt 325 can be made every 1.6 ms when the photoreceptor belt 325 travels at 6 s per belt revolution, which results in measuring about 3750 values of the actual velocity 330. Once the actual velocity 330 of the photoreceptor belt 325 is adjusted, the adjusted velocity is then compared to the reference velocity 320 via the feedback loop 310, and a new velocity error is calculated, the new velocity error being the basis for a new adjustment of the photoreceptor belt velocity. This is standard practice for controlling the velocity of a continuous belt system by means of a feedback encoder and classical control scheme.

Figure 6:
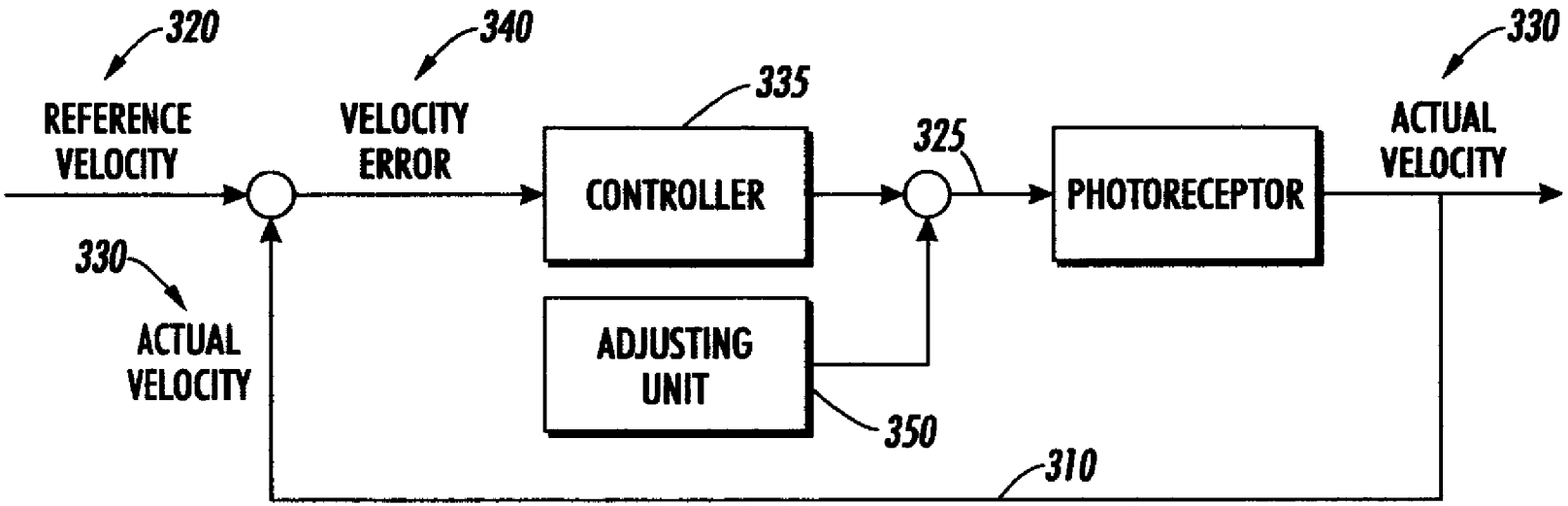
FIG. 6 is a process flow diagram illustrating a feedback loop adjusting the torque disturbance.

FIG. 6 is a process flow diagram illustrating a feedback loop adjusting the photoreceptor velocity on the basis of the torque disturbance. As shown in FIG. 6, once the velocity error 340 is calculated, it is converted into torque disturbance, and a correction factor is then determined on the basis of the torque disturbance. This calculation of correction factor is typically done once at the beginning of a print job. Once the factor is determined for a particular medium, this factor will be valid until the print job ends or until a different medium (paper) is used. An adjusting unit 350 then applies the correction factor to the photoreceptor belt 325, adding the correction factor to the normal compensation provided by the feedback controller. Note that the correction factor is actually a vector of points, one for each position of the belt as it revolves around the photoreceptor module, and, as discussed above, the resulting actual velocity 330 is then measured and compared via the feedback loop 310 to the reference velocity 320. As discussed above, the difference between the actual velocity 330 and the reference velocity 320 constitutes the new velocity error 340, which is used to recalculate the output of the feedback controller 335, but does not update the feed-forward correction waveform provided by adjusting unit, 350, as this output was determined during the learning of the correction waveform.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of correcting a velocity error in a photoreceptor belt of an image forming device, the method comprising:

measuring a velocity error of the photoreceptor belt when a medium is used in the image forming device for a number of image forming operations, the velocity error including a velocity error due to image forming device dynamics and a velocity error due to torque disturbance on the photoreceptor belt;

filtering high frequency velocity error from the measured velocity error;

removing the velocity error due to the image forming device dynamics from the measured velocity error to produce a remaining velocity error;

converting the remaining velocity error to torque disturbance;

determining a correction factor on the basis of the torque disturbance; and adjusting the velocity of the photoreceptor belt on the basis of the determined correction factor.

2. The method of claim 1, wherein the filtering the high frequency velocity error comprises filtering frequencies above about 10 Hz.

3. The method of claim 1, wherein the filtering the high frequency velocity error comprises averaging the velocity error by dividing the remaining velocity error by the number of image forming operations to obtain an average velocity error.

4. The method of claim 1, wherein the removing the velocity error comprises removing velocity error due to photoreceptor dynamics and controller dynamics.

5. The method of claim 1, wherein the converting the remaining velocity error comprises filtering the remaining velocity error by using a filter.

6. The method of claim 1, wherein the converting the remaining velocity error comprises multiplying the remaining velocity error by a differential equation of the $16^{th}$ to the $20^{th}$ order.

7. A system for correcting a velocity error in a photoreceptor belt of an image forming device, the system comprising:

a measuring unit that measures a velocity error of the photoreceptor belt when a medium is used in the image forming device for a number of image forming operations, the velocity error including a velocity error due to image forming device dynamics and a velocity error due to torque disturbance on the photoreceptor belt under control of a controller;

a filtering unit that filters high frequency velocity error from the measured velocity error;

the controller controlling the removal of the velocity error due to the image forming device dynamics from the measured velocity error to produce a remaining velocity error;

the controller controlling the conversion of the remaining velocity error to torque disturbance;

the controller controlling the determination of a correction factor on the basis of the torque disturbance; and a velocity adjustment unit that adjusts the velocity of the photoreceptor belt on the basis of the determined correction factor.

8. The system of claim 7, wherein the filtering unit filters frequencies above about 10 Hz.

9. The system of claim 7, wherein the filtering unit divides the remaining velocity error by the number of image forming operations to obtain an average velocity error.

10. The system of claim 7, wherein the controller removes velocity error due to photoreceptor dynamics and controller dynamics.

11. The system of claim 7, wherein the controller controls the conversion by multiplying the remaining velocity error by a differential equation of the $16^{th}$ to the $20^{th}$ order.

12. A system for correcting a velocity error in a photoreceptor belt of an image forming device, the system comprising:

means for measuring a velocity error of the photoreceptor belt when a medium is used in the image forming device to obtain a velocity error, the velocity error including a velocity error due to image forming device dynamics and a velocity error due to torque disturbance on the photoreceptor belt;

means for filtering high frequency velocity error from the measured velocity error;

means for removing the velocity error due to the image forming device dynamics from the measured velocity error to produce a remaining velocity error;

means for converting the remaining velocity error to torque disturbance;

means for determining a correction factor on the basis of the torque disturbance; and means for correcting the medium velocity factor on the basis of the determined correction factor.

* * * * *